United States Patent [19]

Uffner et al.

[11] 4,451,171

[45] May 29, 1984

[54] POLYAMIDE AS A PRIMER FOR USE WITH ASPHALTIC MEMBRANES

[75] Inventors: William E. Uffner, Newark; Robert N. White, Etna, both of Ohio

[73] Assignee: Owens-Corning Fiberglas Corporation, Toledo, Ohio

[21] Appl. No.: 376,370

[22] Filed: May 10, 1982

Related U.S. Application Data

[62] Division of Ser. No. 205,032, Nov. 7, 1980, Pat. No. 4,362,586.

[51] Int. Cl.[3] ..... E01C 5/22

[52] U.S. Cl. ..... 404/31; 404/47

[58] Field of Search ..... 404/47, 68, 69, 75, 404/72, 31; 428/323; 156/272, 71

[56] References Cited

U.S. PATENT DOCUMENTS

| | | | |
|---|---|---|---|
| 2,472,081 | 6/1949 | Kantor | 404/47 |
| 3,223,005 | 12/1965 | Carlson | 404/47 |
| 3,334,555 | 8/1967 | Nagin et al. | 404/31 |
| 3,377,303 | 4/1968 | Peerman | 260/18 |
| 3,420,789 | 1/1969 | Wilson | 260/18 |
| 3,474,625 | 10/1969 | Draper | 404/47 X |
| 3,483,237 | 12/1969 | Peerman | 260/404.5 |
| 3,520,096 | 7/1970 | Kilcher | 14/16.5 X |
| 3,700,618 | 10/1972 | Sharkey | 260/33.4 R |
| 3,741,856 | 6/1973 | Hurst | 161/88 |
| 3,900,102 | 8/1975 | Hurst | 206/411 |
| 3,900,687 | 8/1975 | Meader | 428/425 |
| 3,919,148 | 11/1975 | Winters | 260/28.5 AS |
| 4,015,302 | 4/1977 | Clark | 14/16.5 |
| 4,074,948 | 2/1978 | Heater | 404/75 |
| 4,111,582 | 9/1978 | Tippett | 14/16.5 X |
| 4,113,401 | 9/1978 | McDonald | 404/75 |
| 4,175,978 | 11/1979 | Marzocchi | 106/281 R |
| 4,237,036 | 12/1980 | Goodrich | 260/28 R |
| 4,273,685 | 6/1981 | Marzocchi | 260/28.5 R |

FOREIGN PATENT DOCUMENTS

| | | | |
|---|---|---|---|
| 7217111 | 12/1973 | France | 260/28.5 |
| 824760 | 12/1959 | United Kingdom | 156/71 |
| 1285541 | 8/1972 | United Kingdom | 14/73 |

OTHER PUBLICATIONS

W. R. Grace Publication Entitled "Heavy Duty Bituthene", 8/74 Printed in U.S.A., Form CMD 362A.

W. R. Grace Publication "Bituthene Waterproofing Systems", 9/78 Printed U.S.A., Form CMD 305L.

Emery Industries Bulletin 105E, Entitled "Emerez Polyamide Resins for the Graphic Arts Industry".

*Primary Examiner*—William F. Pate, III

*Attorney, Agent, or Firm*—Ronald C. Hudgens; Robert F. Rywalski; Keith V. Rockey

[57] ABSTRACT

Polyamide resins are used as primer for highway repairs using asphaltic membranes.

1 Claim, No Drawings

POLYAMIDE AS A PRIMER FOR USE WITH ASPHALTIC MEMBRANES

This is a division of application Ser. No. 205,032, filed Nov. 7, 1980 now U.S. Pat. No. 4,362,586.

FIELD OF THE INVENTION

The present invention relates to the application of asphaltic membranes to cementitious substrates and more particularly the present invention relates to the application of such asphaltic membranes to roads for purposes of repairing defects, for example, cracks.

BACKGROUND

It is known in the art that asphaltic membranes can be applied to cementitious substrates. Exemplifying such prior art are U.S. Pat. Nos. 3,741,856, 3,900,102, and the brochures published by W. R. Grace entitled BITUTHENE Waterproofing Systems and Heavy Duty BITUTHENE. Such membranes comprise a flexible sheet-like support having a pressure sensitive adhesive layer which is a blend of a bitumen and rubber. The supports may take the form of natural rubber or synthetic organic polymers, including polyethylene, polypropylene, polyamides, polyesters, polyvinylchloride, as well as inorganic or metallic supports. Other sheet-like supports include woven and non-woven fabrics of inorganic or organic natural or synthetic fibers (i.e., staple fibers or continuous filaments), for example, woven fabric of fibers of one of the synthetic organic polymers, glass tissue, hessian, cotton, or other fiber scrim or bituminous roofing felt.

Other asphaltic membranes are disclosed in co-pending applications U.S. Ser. No. 167,986 filed July 14, 1980, and U.S. Ser. No. 168,901 also filed July 14, 1980, both of which are hereby incorporated by reference. Such membranes are outstandingly adapted for use in the maintenance, or repair, of roads. As used herein, roads includes highways, streets, parking lots, driveways and the like. Such membranes are flexible laminants of a coated fibrous reinforcement material having an adhesive layer on one side thereof, the coating is the reaction product of asphalt, a non-depolymerized rubber and a polymerizable vinyl aromatic monomer. The adhesive is suitably the reaction product of asphalt, a polymerizable vinyl aromatic monomer, a non-depolymerized rubber, and either depolymerized rubber or a terpene resin, preferably, an admixture of depolymerized rubber and a terpene resin.

In order to enhance the qualities of the bonding of asphaltic membranes to cementitious substrates, for example, asphalt or concrete roads, the use of a primer has been suggested. In this respect, reference may be had to the above indicated brochure, BITUTHENE Waterproofing Systems.

SUMMARY

An improvement in the prior art processes of applying a primer to cementitious substrates and then applying an asphaltic membrane to the primer has now been made. The improvement resides in employing as the primer a polyamide resin, preferably applied in a solvent solution of about 10–15 percent by weight resin solids in anhydrous isopropanol. The polyamide primer acts as a moisture barrier and allows for enhanced bonding to the cementitious substrate. Additionally, the primer extends the low temperature range for adhesive tack.

In a preferred mode of industrially exploiting the present invention, the primer and asphaltic membranes are employed in road repair and maintenance. In this mode of exploiting the invention, a crack in an asphalt or concrete road is filled with a suitable crack-filling material. One such material can be that sold commercially by Owens-Corning Fiberglas Corporation under the trademark ROADBOND material. The road substrate surfaces on opposite sides of such crack are then generally cleaned of loose debris and the polyamide primer is then applied to such surfaces. Preferably, as indicated, the primer will be applied in an organic solvent solution and most desirably in anhydrous isopropanol, as the latter represents a fine balance between low flash point, high volatility and desired solvation properties. An asphaltic membrane with an adhesive layer is then positioned such that the adhesive layer is in contact with the primed surfaces and spans the filled crack. Such repaired roads, if desired, then may be overlayed with a wear course of a paving grade asphalt and when so done, the repaired road will show outstanding resistance to the recurrence of the crack, i.e., reflecting cracking. As previously indicated, the polyamide enhances the water resistant characteristics of the road and enhances the bonding qualities of the asphaltic membrane while surprisingly lowering the tack temperature of the adhesive of the membrane.

DESCRIPTION

The polyamides which will be found to be suitable for purposes of the present invention are film forming polyamides which are solid at room temperature, i.e., solid at about 20°–25° C. Preferably, the polyamide will be soluble in industrial solvents having flash points in excess of about 0° C. Such polyamides are the reaction products of a polycarboxylic acid and a polyamine.

Polyamide resins which will be found to be especially suitable for the present purposes are those which have been employed in the past in the graphic arts industry. Exemplary of such polyamides are those which are commercially available from Emery Industries, Inc. under their trade designations EMEREZ 1530, 1533, 1540, 1548, and 1549 polyamides. These resins generally have softening points between about 99° C. to about 125° C. and viscosity, at 160° C., of about 6 to about 34 poise. The solvent viscosity of suitable resins (40% by weight resin in an isopropanol/heptane solvent system) will be between about 36 to about 70 seconds (25° C., Zahn No. 2). Preferably, the primer will be EMEREZ 1548 polyamide which has a softening point of about 115°–125° C., a viscosity of 6–10 poise (at 160° C.) and a solvent viscosity of about 36 seconds. Such polyamides are low molecular weight reaction products of substantially equivalent weights of a diamine and a mixture of carboxylic acids with the mixture including carboxylic acids having a functionality of at least 3, carboxylic acids having an acid functionality of about 2 and a chain stopping monocarboxylic acid. Typically, suitable polyamides will have a weight average molecular weight of about 2,000 to about 8,000.

The diamines which may be employed comprehend a wide variety, including, for example, aliphatic diamines, cyclic diamines, aromatic diamines, piperazine and aminoalkyl piperazines. More specifically exemplary of the diamines are ethylene diamine, hexamethylene diamine, propylene diamine, cyclohexane 1,2-diamine, xylene diamine, piperazine, aminoethylpiperazine, and mixtures thereof. Outstanding results will be obtained when the mixture of carboxylic acids comprises from about 20 to 90 equivalent percent, preferably 30 to 80 equivalent percent, of polymeric carboxylic acid having an acid functionality of at least about 3, from about 10 to 80 equivalent percent, preferably 30 to 60 percent, of a polymeric carboxylic acid having an acid functionality of about 2, and from about 10 to 60 equivalent percent, preferably about 15 to 50 equivalent percent, of a chain stopping monocarboxylic acid. Preferably, the ratio of the carboxylic acid having a functionality of at least 3 to the carboxylic acid having a functionality of about 2 will be from about 1:4 to 9:1. Desirably, the polymeric carboxylic acid having an acid functionality of at least about 3 will be a trimer acid containing from about 54 to about 72 carbon atoms and the polymeric carboxylic acid having an acid functionality of about 2 will be a dimer acid containing about 22 to 44 carbon atoms. Exemplary of desirable chain stopping monocarboxylic acids are normal aliphatic monocarboxylic acids having from about 2 to 6 carbon atoms, straight chain $C_{12}$ to $C_{22}$ fatty acids, $C_4$ to $C_{20}$ branched acids, 4,4-bis(hydroxyaryl) pentanoic acids, hydroxyaryl $C_{16}$ to $C_{18}$ unsaturated fatty acids, and mixtures thereof. Further details with respect to the method of synthesizing suitable polyamide primers will be found in U.S. Pat. No. 3,700,618, which is hereby incorporated by reference.

Preferably, the polyamides are applied as primers in an organic solvent solution. Exemplary of preferred solvents include alcohols, like isopropanol, n-propanol, n-butanol, methyl isobutyl carbinol, and n-hexanol, amides, like dimethyl formamide, amines, like pyridine and diethylene triamine, and chlorinated solvents, including, for example, chloroform. The following organic solvents if used are preferably used in conjunction with the above indicated solvents: ethanol, cyclohexanol, diacetone alcohol, tetrahydrofurfuryl alcohol, textile spirits, heptane, lactol spirits, VM and P naphtha, ethyl Cellosolve, butyl Cellosolve, SC solvent No. 1, toluene, ethyl acetate, isopropyl acetate, n-propyl acetate, methylene chloride, carbon tetrachloride, perchloroethylene, nitroethane, and 2-nitropropane. The following organic solvents are generally not desirable because of their low polyamide solvation power: methanol, ethylene glycol, diethylene glycol, glycerine, acetone, methyl ethyl ketone, methyl isobutyl ketone, cyclohexanone, ethyl ether, tetrahydrofuran, and dioxane. Generally, the solids concentration of the organic solution will be routinely determined by those skilled in the art, but it is typically preferred to employ a resin solids concentration of about 10–15% by weight. As indicated, a preferred solvent is anhydrous isopropanol.

The following illustrates a preferred mode of practicing and commercially exploiting the present invention. In order to provide a suitable asphaltic membrane, a chemically modified asphalt is prepared by (in accordance with U.S. Serial No. 045,047 which is hereby incorporated by reference) reacting the following constituents at about 340° F. (about 171° C.) for about 24 hours:

Pavement Grade Asphalt (AC-20)—77.5 Parts By Weight
Styrene—10.0 parts by weight
Non-depolymerized rubber (Solprene 1205C)—12.5 parts by weight An adhesive is prepared by reacting the following ingredients for about 20 hours at about 340° F. (about 171° C.):

Pavement Grade Asphalt (AC:20)—120.0 Parts By Weight
Depolymerized natural rubber (DPR-400)—18.7 parts by weight
Styrene—18.7 parts by weight
Non-depolymerized rubber (Solprene 1205C)—25.5 parts by weight
Terpene Resin (Nevpene 9500)—74.1 parts by weight Woven glass roving (24 ounces per square yard) is dipped into a hot melt of the above chemically modified asphalt to coat it and the coated product cooled. The cooled coated membrane is then coated on one side with a hot melt of the adhesive, followed by cooling and the application of Daubert Paper Company's releasable paper (l-60-EKPL-164 or 2-80-EKPL-164) to the adhesive layer. This laminant is then formed into a roll for on-site use as an asphaltic road repair membrane. A primer is prepared by dissolving one part by weight of EMEREZ 1548 polyamide in 7 parts by weight of anhydrous isopropanol. The mixture is heated to about 125° F. (51.7° C.) and mixed to effect solvation. Roads are repaired by filling the cracks with suitable conventional fillers. One filler can be the above-identified chemically modified asphalt used in conjunction with aggregate, or even ground reclaimed asphaltic highway materials. The surface of the road adjacent the crack is then coated with the primer and the solvent is allowed to evaporate. The roll of asphaltic membrane is then applied by removing the release paper and applying the side with the adhesive directly onto the primed surface. The repaired area is then rolled and an outstandingly durable bond is obtained between the primed substrate and the asphaltic membrane. The primer also functions to increase the water resistance. If desired, a wear course may be applied above the repaired area.

While the above describes the present invention, it will, of course, be apparent that modifications are possible which, pursuant to the patent statutes and laws, do not depart from the spirit and scope thereof.

We claim:

1. In a repaired cementitious road comprising a road substrate having a crack therein containing a crack filling material, a primer disposed on opposite surfaces of said road substrate adjacent said crack and an asphaltic membrane spanning said crack and being in contact with said primer on said opposite surfaces, the improvement wherein said primer is a polyamide having a softening point between about 99° C. to about 125° C. and a viscosity at 160° C. of about 6 to about 34 poise.

* * * * *